US009591906B2

(12) United States Patent
Guy-Rabi et al.

(10) Patent No.: US 9,591,906 B2
(45) Date of Patent: Mar. 14, 2017

(54) HAIR STRAIGHTENING BRUSH

(71) Applicant: GUY A. SHAKED INVESTMENTS LTD., Tel Aviv (IL)

(72) Inventors: Sharon Guy-Rabi, Ra'anana (IL); Yakov Guy, Ra'anana (IL)

(73) Assignee: GUY A. SHAKED INVESTMENTS LTD., Tel Aviv (IL)

( * ) Notice: Subject to any disclaimer, the term of this patent is extended or adjusted under 35 U.S.C. 154(b) by 18 days.

(21) Appl. No.: 14/401,540

(22) PCT Filed: May 16, 2013

(86) PCT No.: PCT/IL2013/050420

§ 371 (c)(1),
(2) Date: Nov. 17, 2014

(87) PCT Pub. No.: WO2013/171750

PCT Pub. Date: Nov. 21, 2013

(65) Prior Publication Data

US 2015/0101139 A1 Apr. 16, 2015

Related U.S. Application Data

(63) Continuation of application No. PCT/IL2013/050017, filed on Jan. 6, 2013.

(30) Foreign Application Priority Data

May 17, 2012 (IL) ..... 219875

(51) Int. Cl.
*A45D 24/10* (2006.01)
*A45D 7/00* (2006.01)
(Continued)

(52) U.S. Cl.
CPC ..... *A45D 7/00* (2013.01); *A45D 2/001* (2013.01); *A45D 20/48* (2013.01); *A46B 9/06* (2013.01);
(Continued)

(58) Field of Classification Search
CPC ..... A45D 2/001; A45D 2/002; A45D 20/48; A45D 2200/152; A46B 9/06; A46B 15/003; A46B 2200/104; A46D 99/00
See application file for complete search history.

(56) References Cited

U.S. PATENT DOCUMENTS 943,321 A 12/1909 Shero
3,760,821 A 9/1973 Weddington
(Continued)

FOREIGN PATENT DOCUMENTS

CN 2183694 11/1994
CN 1235524 11/1999
(Continued)

OTHER PUBLICATIONS

International Search Report from Interntional Application No. PCT/IL2013/050420 dated Aug. 28, 2013.

*Primary Examiner* — Rachel Steitz
(74) *Attorney, Agent, or Firm* — Dorsey & Whitney LLP

(57) ABSTRACT

A brush is provided herein, the brush having heating elements dispersed on and protruding from its face and spacers arranged to maintain a specified distance between protruding ends of the heating elements and a scalp of a head that is being brushed. The spacers are dispersed on the brush's face at a specified density that assures maintaining the specified distance with respect to a resilience of the spacers.

20 Claims, 5 Drawing Sheets

(51) Int. Cl.

| | |
|---|---|
| ***A46B 9/06*** | (2006.01) |
| ***A46B 15/00*** | (2006.01) |
| ***A45D 20/48*** | (2006.01) |
| ***A45D 2/00*** | (2006.01) |
| ***A46D 99/00*** | (2006.01) |
| ***A46D 3/00*** | (2006.01) |

(52) U.S. Cl.
CPC ..... *A46B 15/003* (2013.01); *A46D 3/00* (2013.01); *A46D 99/00* (2013.01); *A45D 2200/152* (2013.01); *A46B 2200/104* (2013.01)

(56) References Cited

U.S. PATENT DOCUMENTS

| | | | | |
|---|---|---|---|---|
| 4,126,143 | A | 11/1978 | Schroeder | |
| 4,217,915 | A † | 8/1980 | Gress | |
| 4,623,779 | A | 11/1986 | Raab | |
| 5,673,710 | A | 10/1997 | Schaefer et al. | |
| 5,771,904 | A | 6/1998 | Lange et al. | |
| 2005/0109755 | A1 * | 5/2005 | Rachal | A45D 2/002 219/222 |
| 2010/0101594 | A1 | 4/2010 | Pulfrey | |
| 2012/0080047 | A1 | 4/2012 | Glucksman | |

FOREIGN PATENT DOCUMENTS

| | | |
|---|---|---|
| CN | 2533705 | 2/2003 |
| CN | 102150990 | 8/2011 |
| CN | 202168543 | 3/2012 |
| CN | 202184301 | 4/2012 |
| JP | 1166705 | 6/1989 |
| KR | 20070100436 | 10/2007 |
| WO | WO 2011/078593 | 6/2011 |

* cited by examiner
† cited by third party

HAIR STRAIGHTENING BRUSH

CROSS-REFERENCE TO RELATED APPLICATIONS

This application is a National Phase Application of PCT International Application No. PCT/IL2013/050420, International Filing Date May 16, 2013, claiming priority of PCT Patent Application No. PCT/IL2013/050017, filed Jan. 6, 2013, and Israeli Patent Application No. 219875, filed May 17, 2012, all of which are hereby incorporated by reference.

BACKGROUND

1. Technical Field

The present invention relates to the field of hair heat treatment, and more particularly, to brush-like hair straighteners.

2. Discussion of Related Art

Hot combs have been used since the late $19^{th}$ century, however operational considerations and safety requirements have been limiting their applicability.

BRIEF SUMMARY

One aspect of the present invention provides a brush comprising a plurality of heating elements protruding from a face of the brush, the heating elements dispersed on the brush's face at a specified density; and a plurality of spacers arranged to maintain a specified distance between protruding ends of the heating elements and a scalp of a head that is being brushed, the spacers dispersed on the brush's face at a specified density that assures maintaining the specified distance with respect to a resilience of the spacers.

These, additional, and/or other aspects and/or advantages of the present invention are set forth in the detailed description which follows; possibly inferable from the detailed description; and/or learnable by practice of the present invention.

BRIEF DESCRIPTION OF THE DRAWINGS

For a better understanding of embodiments of the invention and to show how the same may be carried into effect, reference will now be made, purely by way of example, to the accompanying drawings in which like numerals designate corresponding elements or sections throughout.

In the accompanying drawings.

DETAILED DESCRIPTION

Figure 1B:
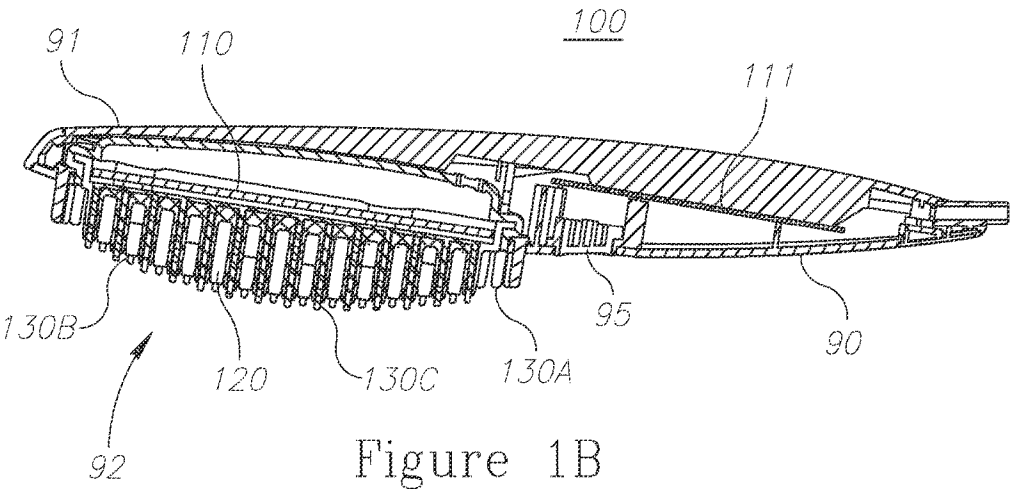
FIGS. 1A-1C are high level schematic illustrations of a brush according to some embodiments of the invention.

Prior to setting forth the detailed description, it may be helpful to set forth definitions of certain terms that will be used hereinafter.

The term "heating element" as used herein in this application refers to any type of heat conductive element, in particular metal (e.g. aluminum) heat conductors. Heating elements may have any shape, e.g. elongated, flat, conical, have a cross section that is round, elliptic or flat etc. Heating elements may have a cross section that varies in shape, and heating elements of varying forms may be combined on a single brush.

The term "spacer" as used herein in this application refers to any structure arranged to keep a clearance or a specified distance between heating elements of the brush and the scalp of the user's head. Spacers may have any form and may be positioned on the brush and/or on the heating elements. Spacers may be made of any material, preferable a heat insulating material. Different types of spacers may be used at different regions of the brush.

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

Before explaining at least one embodiment of the invention in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting.

Figure 1C:
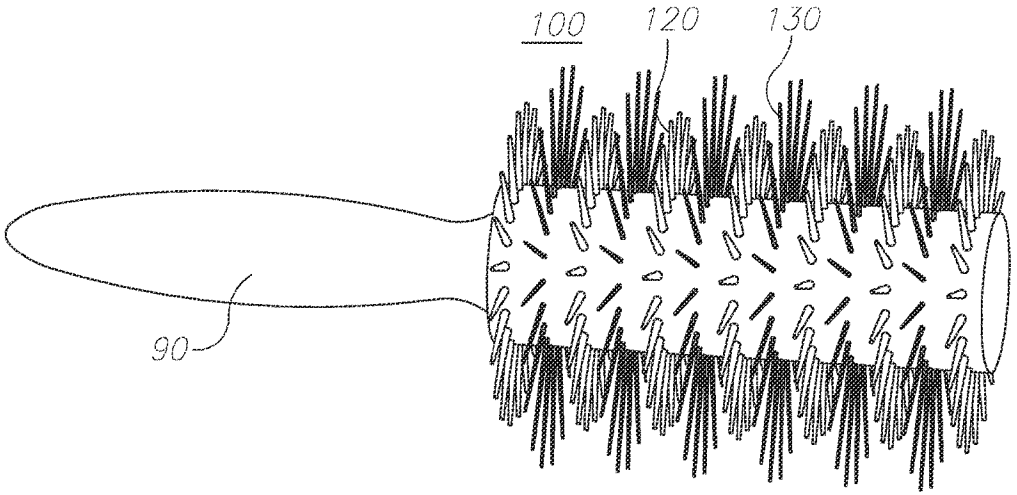
Figure 1A:
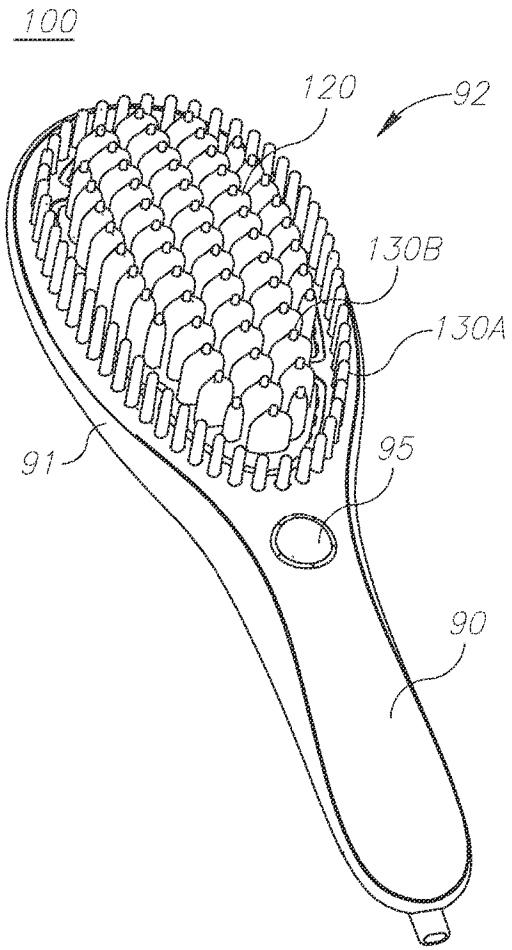

FIGS. 1A-1C are high level schematic illustrations of a brush 100 according to some embodiments of the invention. FIG. 1A is a perspective view, FIG. 1B is a cross sectional view and FIG. 1C is a side view. FIGS. 2A-2C and 3A-3D are high level schematic illustrations of various arrangements of heating elements 120 and spacers 130 of brush 100 according to some embodiments of the invention. Brush 100 comprises heating elements 120 dispersed on and protruding from its face and spacers 130 arranged to maintain a specified distance between protruding ends of heating elements 110 and a scalp of a head that is being brushed. Spacers 130 are dispersed on the brush's face at a specified density that assures maintaining the specified distance with respect to a resilience of spacers 130.

FIGS. 1A and 1B illustrate flat, essentially one-sided brush 100, having a back 91, a handle 90, an operation button 95 and optionally an operation indicator and a heating level selector (not shown). In the cross sectional view of FIG. 1B, heat source 110 is visible, as well as the internal structure of elements in handle 90. FIG. 1C illustrates a cylindrical brush 100 having dispersed heating elements 120 and spacers 130. In these embodiments, some of spacers 130 may be connected on top (126) of some of heating elements 120 (130B) or among heating elements 120 (130C).

Figure 2B:
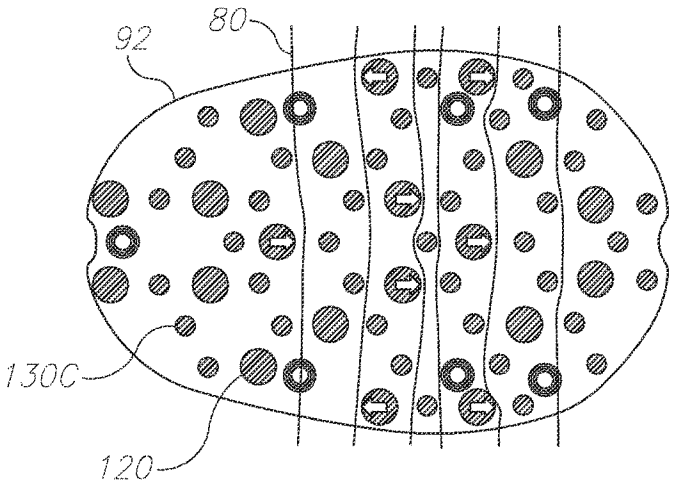
FIGS. 2A-2C and 3A-3D are high level schematic illustrations of various arrangements of the heating elements and spacers of the brush according to some embodiments of the invention.
Figure 2A:
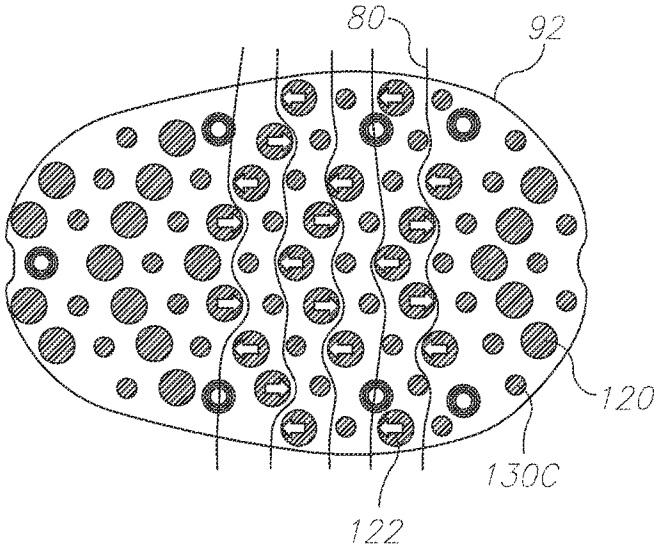

FIGS. 2A and 2B illustrate two configurations of heating elements 120 and spacer 130 on brush's face 92. FIG. 2A illustrates a dense arrangement of heating elements 120 and spacer 130 in which there is a high probability of each hair 80 contacting at least one heating element 120 and each hair 80 is likely to be extensively heated. FIG. 2B illustrates a less dense arrangement of heating elements 120 and spacers 130 in which heating elements 120 are spread apart in respect to FIG. 2A. As heating elements 120 are more remote from each other, there is a lower probability of each hair 80 contacting at least one heating element 120 and each hair 80 is likely to be heated more mildly than in the embodiment illustrated in FIG. 2A. In general, the configuration of heating elements 120 and spacers 130 is selected according to operative and safety requirements to provide an effective and safe brush.

Brush 100 comprises a plurality of heating elements 120 protruding from a face 92 of brush 100. Heating elements 120 may be elongated with any shape of cross section (e.g. round in FIG. 2A, elliptic in FIG. 1A, variable in FIG. 3A etc.). Heating elements 120 are made of heat conductive material, as a non-limiting example, aluminum. In embodiments, the heat conductive material may have a thermal conductivity which is comparable to high quality aluminum (over 200 W/m° K.), lower conductivity of 50-200 W/m° K. or even low thermal conductivity between 20-50 W/m° K. The thermal conductivity may be selected with respect to overall efficiency and safety requirements.

Heating elements 120 conduct heat from a heat source 110 such as a heating body, which may receive energy from a battery in brush 100 or from an external source. Good thermal contact may be established between heat source 110 and heating elements 120, e.g. using a thermal paste, or by constructing heat source 110 and heating elements 120 as a single body. In embodiments, heating elements 120 may comprise internal heat sources (not shown) such as small resistors to improve the heating efficiency. The internal heat sources may replace or enhance a central heat source. In embodiments, heating elements 120 may comprise electrical heating wires. Brush 100 may further comprise a control unit 111 arranged to control heating elements 120 and/or heat source 110. Control unit 111 may be positioned in handle 90 of brush 100.

Heating elements 120 may reach temperature between 140-240° C., which are useful for straightening hair. Heating elements 120 may be arranged and constructed to minimize hair damages during the straightening process, e.g. avoid scratching the hair, avoid excessive stretching of the hair, avoid scalp injuries etc.

Heating by heating elements may be carried out in all directions or in specified directions (see e.g. direction 122 in FIGS. 2A and 2B) in cooperation with the arrangement of heating elements 120 on the brush's face. Brush 100 thus provides three dimensional heating of the hair. The spacer configuration ensures a safe and efficient straightening effect.

Brush face 92 may comprise a heat source connected to heating elements 120. Heating elements 120 are dispersed on at least a part of brush's face 92 at a specified density. The specified density may vary between different regions of face 92, as explained below. Heating elements 120 provide a large heating surface area for straightening hairs. For example, while a surface of a heat may be 40 $cm^2$ (generally between 10-80 $cm^2$, depending on the brush size), the overall surface of heating elements 120 may be twenty-fold, or between 5 and 70 times the area of face 92. Such increase in the contacting surface area increases the efficiency of heat delivery to the hair.

Protruding ends 125 of heating elements 120 may be smooth or rounded to prevent accidental injury, protect the hair, allow easy brushing of the hair and ensure uniform heat delivery.

Brush 100 further comprises a plurality of spacers 130 arranged to maintain a specified distance or a clearance between protruding ends 125 of heating elements 120 and a scalp of a head that is being brushed (see below, FIG. 3A). Spacers 130 may have any form and may be positioned on brush 100, on heating elements 120, among heating elements 120 (see e.g. 130C in FIG. 3C) or in a combination thereof (see e.g. FIG. 1A, where different types of spacers 130 are used at different regions of brush 100). Spacers 130 located on the brush's face 92 are marked 130A, spacers 130 located on top of heating elements 120 are marked 130B and spacers 130 located among the heating elements 120 are marked 130C. In embodiments, some or all of heating elements 120 may be surrounded by spacers 130.

Spacers 130 may be made of any material, preferable a heat insulating material, e.g. plastic or silicon. In embodiments, the heat insulating material may have a thermal conductivity which is lower than 10 W/m° K.

For example, spacers 130 may comprise flexible bristles arranged to protect the scalp from a temperature of heating elements reaching 140° C. or more.

Spacers 130 are dispersed on brush 100's face 92 at a specified density that assures maintaining the specified distance with respect to a resilience of spacers 130, as explained below.

In a non-limiting example, heating elements 120 may be 3 mm-50 mm high, and may vary in height across face 92. Spacers 130 may be higher than adjacent heating elements 120 by 1 mm-30 mm depending on their density (and the intervals between adjacent spacers 130), resilience, density and dimensions of heating elements 120 and application scenarios (e.g. type and length of hair, applies heat, user sensitivity etc.). The distribution and forms of spacers 130 may be adapted to the distribution of heating elements 120 (e.g. a region with taller or denser heating elements 120 may have taller or denser spacers 130). The distribution of heating elements 120 may also be adapted to application scenarios, e.g. denser hair may be treated with longer and possibly less dense heating elements 120 (e.g. 25 mm long) while thinner hair may be treated with shorter and possibly denser heating elements 120 (e.g. 10 mm long).

Figure 3B:
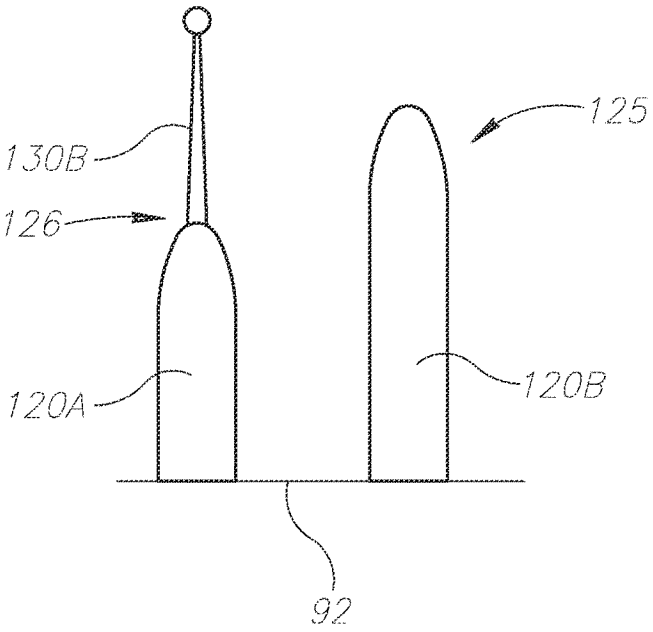
Figure 3A:
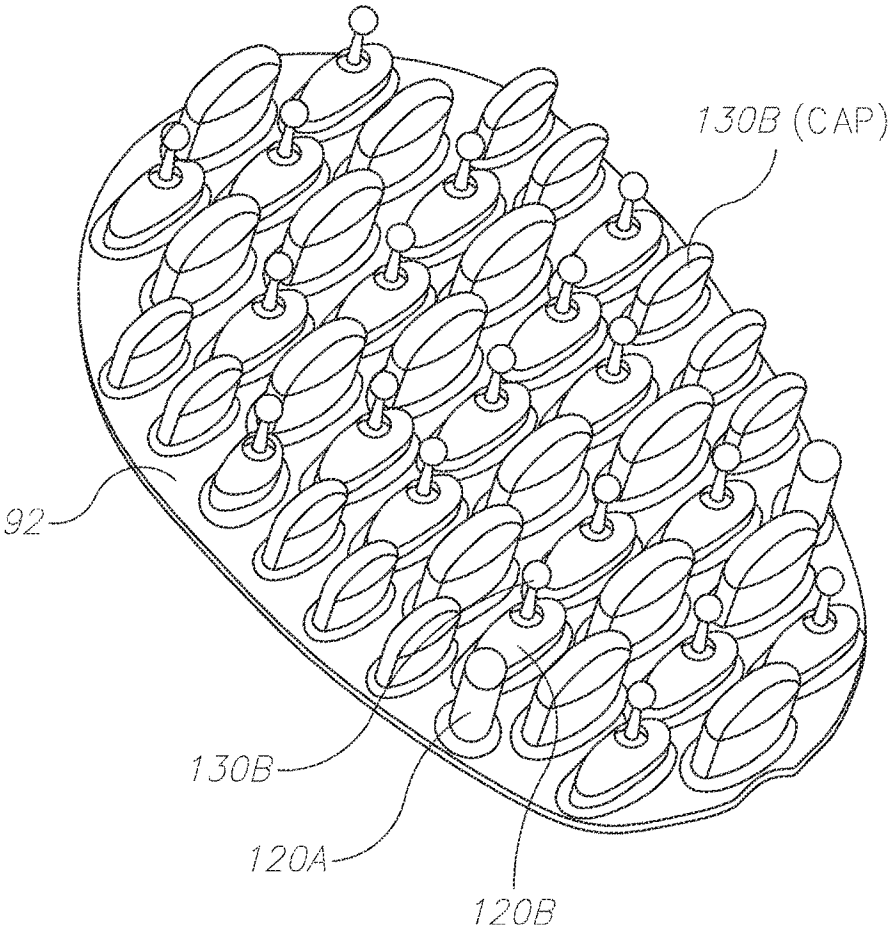
Figure 3C:
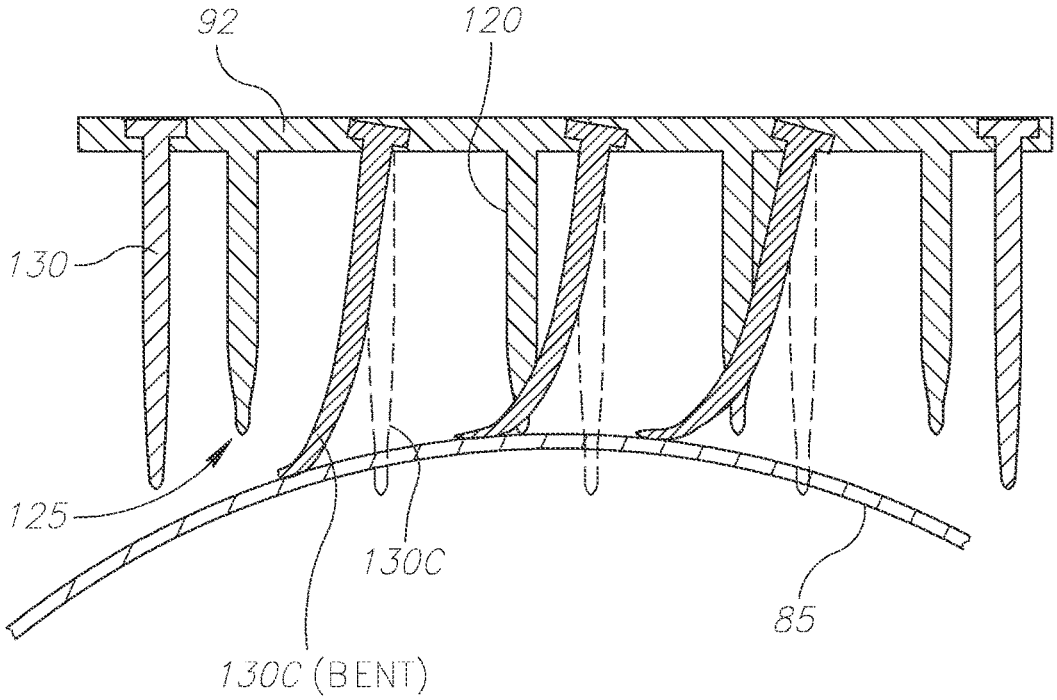

FIG. 3C illustrates the relation between the resilience of spacers 130 and the height difference between spacers 130 and heating elements 120. Spacers 130C are illustrated in their upright position (hatched) and in a bent position during application of brush 100. Additional spacer types (130A, 130B) may also be present in this configuration (not shown). The height difference may be large enough to provide a safety distance to scalp 85 even in the most aggressive application scenario, or the height difference and spacer resilience may be configured to assure safe application in normal or other scenarios.

In embodiments, the specified densities of heating elements 120 and of spacers 130 may be variable across the face of brush 100 and be related to maintain the specified distance between protruding ends 125 of heating elements 120 and scalp 85 under at least one usage scenario.

Figure 2C:
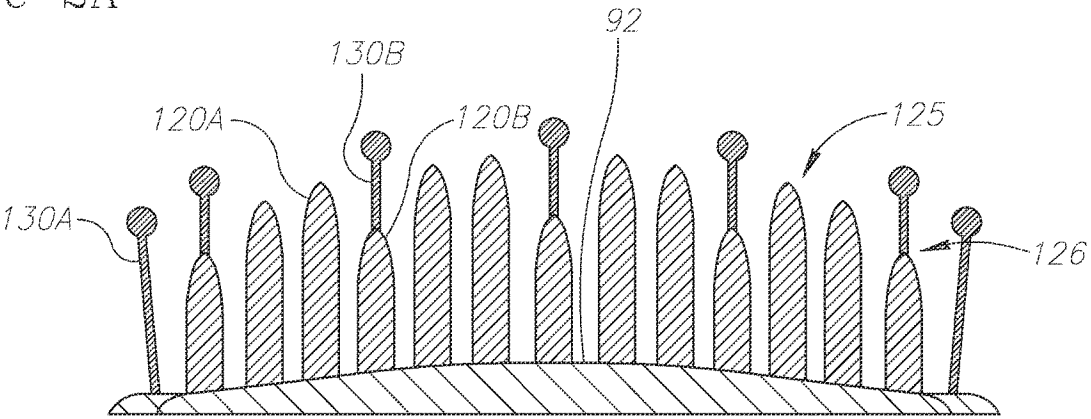
Figure 3D:
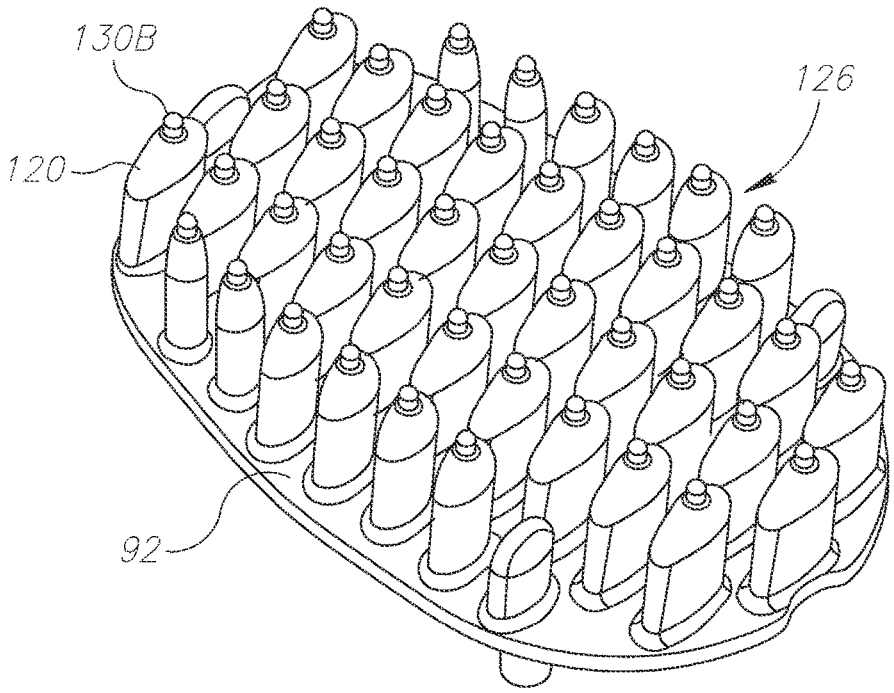

As illustrated in FIGS. 2C, 3A and 3B, spacers 130A and/or 130C may protect the sides of brush 100 while spacers 130B may be connected on top (126) of some or all of heating elements 120 (see FIGS. 3A, 3D). Some of heating elements 120 may be lower than other heating elements 120 and some of heating elements 120 may hold spacers 130B attached to their tops 126. In embodiments, spacers 130 may be connected to sides of heating elements 120. In embodiments, heating elements 120 may vary in shape and size across face 92 (FIGS. 3A, 3D) and spacers 130 may be designed accordingly to enhance safety. Face 92 may be bended to further increase the effective heat application area (see FIG. 2C).

One non-limiting example for brush 100 is illustrated in FIGS. 3A and 3B. In this example, brush face 92 is 55 mm×85 mm. Connected to face 92 are heating elements 120B which are 12 mm high and heating elements 120A which are 8 mm high and have spacers 130 which are 16 mm high connected on top. The specified distance which is kept between heating elements 120 and scalp 85 in an non-bended state of spacers 130 is hence 4 mm. Spacers 130 may be short and stiff bristles which do not bend mush during application, to maintain the specified safety distance quite constant. In an example, brush 100 uses 500 W and provides a heated area of 520 $cm^2$.

In embodiments, the specified distance between heating elements and scalp 85 may be between 1 and 30 mm.

Another non-limiting example for brush 100 is illustrated in FIG. 3D. In this example, all heating elements 120 are protected with soft silicon spacers 130, which may extend also to sides of heating elements 120 (not shown). In an example illustrated in FIG. 3A, some of heating elements 120 may comprise spacers 130 as caps 130B and others as bristles 130B.

Another non-limiting example for brush 100 is illustrated in FIG. 3C. In this example, resilient spacers 130C both protect scalp 85 and provide a pleasant feel while using brush 100, due to their bending upon contacting scalp 85.

In embodiments, spacers 130 may be positioned on any of brush face (130C), brush face periphery (130A in FIG. 1A) or on top of heating elements 120 (130B). Different spacers 130 may be arranged to provide scalp protection under different usage scenarios. For example, some spacers 130 may be stiffer to protect the scalp during forceful brushing and other spacers 130 may by compliant to provide protection as well as a pleasant feel during smooth brushing.

In embodiments, the specified density of heating elements 120 may be between 0.2 and 15 per $cm^2$. For example, heating elements 120 may be 3 mm wide (at their base) and 1-2 mm apart. In embodiments, heating elements 120 may be 4-5 mm apart (measured between base centers of heating elements 110). In another example heating elements 120 may be 20 mm wide and 10 mm apart. Intermediate examples may be selected according to the required application.

Figure 4:
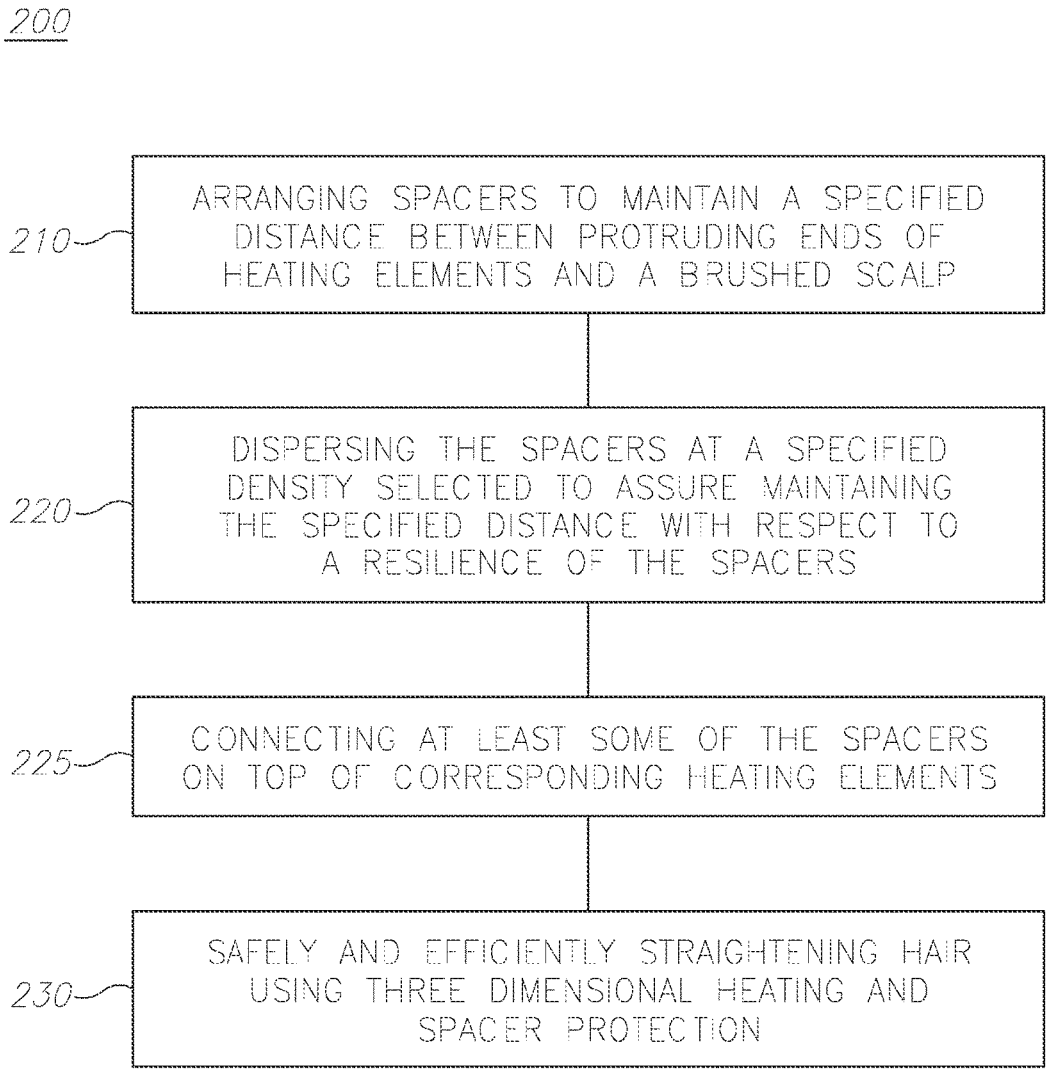
FIG. 4 is a high level schematic flowchart illustrating a method according to some embodiments of the invention.

FIG. 4 is a high level schematic flowchart illustrating a method according to some embodiments of the invention.

Method 200 comprises arranging spacers to maintain a specified distance between protruding ends of heating elements and a brushed scalp (stage 210), dispersing the spacers at a specified density selected to assure maintaining the specified distance with respect to a resilience of the spacers (stage 220) and thereby safely and efficiently straightening hair using three dimensional heating and spacer protection (stage 230). In embodiments, method 200 further comprises connecting at least some of the spacers on top of corresponding heating elements (stage 225) and generally arranging the spacers in a way that keeps the heating elements at a safety distance from the scalp under any usages scenario.

In the above description, an embodiment is an example or implementation of the invention. The various appearances of "one embodiment", "an embodiment" or "some embodiments" do not necessarily all refer to the same embodiments.

Although various features of the invention may be described in the context of a single embodiment, the features may also be provided separately or in any suitable combination. Conversely, although the invention may be described herein in the context of separate embodiments for clarity, the invention may also be implemented in a single embodiment.

Embodiments of the invention may include features from different embodiments disclosed above, and embodiments may incorporate elements from other embodiments disclosed above. The disclosure of elements of the invention in the context of a specific embodiment is not to be taken as limiting their used in the specific embodiment alone.

Furthermore, it is to be understood that the invention can be carried out or practiced in various ways and that the invention can be implemented in embodiments other than the ones outlined in the description above.

The invention is not limited to those diagrams or to the corresponding descriptions. For example, flow need not move through each illustrated box or state, or in exactly the same order as illustrated and described.

Meanings of technical and scientific terms used herein are to be commonly understood as by one of ordinary skill in the art to which the invention belongs, unless otherwise defined.

While the invention has been described with respect to a limited number of embodiments, these should not be construed as limitations on the scope of the invention, but rather as exemplifications of some of the preferred embodiments. Other possible variations, modifications, and applications are also within the scope of the invention. Accordingly, the scope of the invention should not be limited by what has thus far been described, but by the appended claims and their legal equivalents.

What is claimed is:

1. A hairbrush, comprising:

a plurality of heating elements protruding from a face of the hairbrush, the plurality of heating elements defining a hair treating area dispersed on at least a part of the hairbrush's face at a specified density;

a plurality of heat insulating spacers each of which includes an end spaced from the face of the hairbrush, the plurality of heat insulating spacers configured on top of at least some of the plurality of heating elements, thereby giving rise to a space between the plurality of heating elements and a user's scalp during use; and a plurality of heat insulating elongate peripheral spacers disposed at least around a portion of the hair treating area of the hairbrush, each of the plurality of heat insulating elongate peripheral spacers including an end spaced from the face of the hairbrush, at least some of the ends of the plurality of heat insulating elongate peripheral spacers located closer to the face than the ends of the plurality of heating insulating spacers.

2. The hairbrush of claim 1, wherein the plurality of heating elements are arranged to maintain a specified distance between protruding ends of the plurality of heating elements and the user's scalp at between 1 mm and 30 mm.

3. The hairbrush of claim 1, wherein the specified density of the plurality of heating elements is between 0.2 per $cm^2$ and 15 per $cm^2$.

4. The hairbrush of claim 1, wherein at least some of the plurality of heat insulating spacers that are connected on top of corresponding ones of the plurality of heating elements comprise silicon caps.

5. The hairbrush of claim 1, further comprising a heat source arranged to heat the plurality of heating elements.

6. The hairbrush of claim 1, wherein at least some of the plurality of heating elements comprise internal heat sources.

7. The hairbrush of claim 1, further comprising a control unit arranged to control the plurality of heating elements.

8. The hairbrush of claim 1, configured as a one-sided brush.

9. The hairbrush of claim 1, wherein the specified density of the plurality of heating elements and a specified density of the plurality of heat insulating spacers are variable across the face of the hairbrush and the specified densities are related to maintain the specified distance between protruding ends of the plurality of heating elements and the user's scalp under at least one usage scenario.

10. The hairbrush of claim 1, wherein the plurality of heat insulating elongate peripheral spacers are stiff and extend around at least a portion of the hair treating area.

11. The hairbrush of claim 1, wherein the plurality of heat insulating elongate peripheral spacers are integrated with the face of the hairbrush around the heating area.

12. The hairbrush of claim 1, wherein the plurality of heating elements are arranged in a pattern resulting in a plurality of substantially parallel undulating paths in at least one direction of hair strand entry.

13. The hairbrush of claim 1, wherein the plurality of heating elements are arranged in a pattern resulting in a plurality of substantially parallel undulating paths in at least one direction of hair strand entry, and wherein the plurality of heating elements are disposed in a pattern offering a smooth path extending at an orientation other than the plurality of substantially parallel undulating paths in at least one direction of hair strand entry.

14. The hairbrush of claim 1, wherein the plurality of heating elements are arranged in a pattern such that, along one axis, the plurality of heating elements are equally spaced.

15. The hairbrush of claim 1, further comprising:

a heating plate extending over the face of the hairbrush;

wherein the plurality of heating elements are integrated with and thermally coupled to the heating plate;

wherein the heating plate and the plurality of heating elements collectively define the hair treating area.

16. The hairbrush of claim 15, wherein the heating plate is curved.

17. The hairbrush of claim 15, wherein the heating plate is convexly curved.

18. A method, comprising:

arranging a plurality of spacers to maintain a specified distance between protruding ends of a plurality of heating elements protruding from a face of a hairbrush and a scalp of a head that is being brushed, the hairbrush further including a plurality of heat insulating elongate peripheral spacers disposed at least around a portion of the plurality of spacers and the plurality of heating elements with ends of the plurality of heat insulating elongate peripheral spacers being closer to the face of the hairbrush than ends of the plurality of spacers;

wherein the plurality spacers are dispersed on at least a part of the hairbrush's face at a specified density selected to assure maintaining the specified distance with respect to a resilience of the plurality of spacers.

19. The method of claim 18, further comprising connecting at least some of the plurality of spacers on top of corresponding ones of the plurality of heating elements.

20. The hairbrush of claim 1, wherein the plurality of heat insulating elongate peripheral spacers are disposed around substantially an entirety of the hair treating area of the hairbrush including the plurality of heating elements and the plurality of heating insulating spacers.

* * * * *